US005388519A

United States Patent [19]

Guindon et al.

[11] Patent Number: 5,388,519

[45] Date of Patent: Feb. 14, 1995

[54] LOW TOXICITY PRIMER COMPOSITION

[75] Inventors: Louise Guindon, Laval; Danielle Allard, Ancienne Lorette, both of Canada

[73] Assignee: SNC Industrial Technologies Inc., Montreal, Canada

[21] Appl. No.: 95,522

[22] Filed: Jul. 26, 1993

[51] Int. Cl.[6] ..... C06B 45/00; D03D 23/00

[52] U.S. Cl. ..... 102/292; 102/285; 149/39; 149/108.2; 149/109.6

[58] Field of Search ..... 102/204, 285, 292; 149/39, 108.2, 109.6

[56] References Cited

U.S. PATENT DOCUMENTS 3,698,319 10/1972 Quinlan et al. ..... 102/45
3,971,319 7/1976 Larson ..... 102/24 R
4,145,969 3/1979 Gawlick et al. ..... 102/204
4,429,632 2/1984 Yunan ..... 102/202.13
4,497,251 2/1985 Rucker ..... 102/202.6
4,696,705 9/1987 Hamilton ..... 149/21
5,074,938 12/1991 Chi ..... 149/21
5,216,199 6/1993 Bjerke et al. ..... 102/471

*Primary Examiner*—Peter A. Nelson

[57] ABSTRACT

A low toxicity primer composition is provided incorporating a heavy-metal free primer explosive sensitizer, metallic fuel and an oxidizer selected from an oxidizer selected from the group consisting of cesium nitrate, strontium sulfate, strontium oxalate, sodium oxalate, nitroguanadine, guanadine nitrate, penthrite, zirconium oxide, and mixtures thereof.

17 Claims, No Drawings

LOW TOXICITY PRIMER COMPOSITION

FIELD OF THE INVENTION

This invention relates to primers used in cartridges for fire arms. In particular it relates to a chemical composition for a primer which is of reduced toxicity.

BACKGROUND OF THE INVENTION

The smallest component in small arms ammunition, the percussion primer, is the link between the striking of the firing pin and the separation of the projectile from the cartridge casing. Despite its critical function, percussion primers are the most frequently overlooked and misunderstood cartridge component, probably because of the complexity of the chemical system which they embody. This chemical system is based on a composition which is often referred to as a "priming composition" or "priming mix".

From the original development percussion primers by an American, Joshua Shaw, and an Englishman, Joseph Egg, about 1815, priming compositions have undergone relatively gradual changes. For a period, mercury fulminate was the most commonly used priming composition. In the 1920s, alternate priming mixes were found to replace mercury fulminate, as this latter composition was found to deteriorate too rapidly under tropical conditions. However, the alternate mixes, based on lead thiocyanate/potassium chlorate formulations, were soon recognized as detrimental to weapon barrels because of the formation of corrosive water soluble potassium chloride salts on combustion.

The late 1930s brought a new class of priming compositions which proved to be non-corrosive to small arms barrels: they were based on the primary explosive called lead styphnate, a substance which is much more stable than mercury fulminate. These compositions are still in use today. However, they suffer from the undesirable creation of airborne particles containing lead and other heavy metals. Government regulations are increasingly being imposed on firearms training procedures based on concern for the potential injurious effects on individual health of such metals.

Except for the first primer using pure mercury fulminate as an igniter, all other common priming compositions are chemical mixtures of, at least, a primary explosive, an oxidizing compound and a fuel source. To these are generally added other ingredients such as sensitizers and binders. The three main ingredients are essential to meet the input (sensitivity) and the output (ignition) requirements for a given primer. A typical primer based on lead styphnate would, for example, commonly incorporate barium nitrate as an oxidizer and antimony sulphide as a fuel and friction producing agent as well as aluminum, another fuel, and tetracene, a sensitizer.

The challenge of reducing the potential deleterious effects of priming compositions on individual health is not an easy one to meet. The replacement of toxic ingredients contained in the current compositions, essentially heavy metal compounds, must be effected without impairing performance. Thus, alternate compositions must have a level of sensitivity similar to that of lead styphnate primers, a temperature stability at least equivalent to that of the current composition and must produce neither environmentally undesirable nor corrosive by-products.

In the past ten years, many researchers have been working to find non-toxic or less-toxic priming compositions but the available prior art all show some significant drawbacks. For example, U.S. Patent No. 4,581,082 to Hagel et al, as well as U.S. Patent No. 4,608,102 to Krampen et al, both correctly addressed the problem of the toxicity of the combustion by-products but their primers have one idiosyncrasy: they tend to deteriorate upon exposure to high temperatures. Another solution provided in U.S. Patent No. 4,963,201 by Bjerke et al is one of a primer composition with environmentally acceptable by-products, free of toxic compounds. But the Bjerke composition demands a critical and difficult preparation procedure in order to accommodate the mixing problems associated with the use of strontium nitrate as the oxidizer.

Accordingly, a principal object of the present invention is to provide a primer composition for use in small arms and other forms of ammunition that has similar or improved characteristics compared to current lead styphnate priming compositions without producing toxic emanations containing lead, barium, antimony or other heavy metals.

It is also an objective to provide a primer composition that is thermally stable.

Another object is to provide a non-corrosive mix to prevent premature corrosion of barrels upon firing.

A further object is to identify a primer composition that is easily adaptable to existing, regular processes for production methods of small arms primers, that is, a solution that would not require further manufacturing steps or inconveniences compared to production of current lead styphnate primers.

Still another objective of the present invention is to provide a solution which will not adversely affect primer costs.

The invention herein in its general form, will now be summarized, and then its implementation in the form of specific embodiments will be detailed with reference to the tables following hereafter. These embodiments are intended to demonstrate the principle of the invention, and the manner of its implementation. As such they are merely exemplary. The invention will then be further described, and defined, in its most general and more specific forms by means of the series of claims which conclude this Specification.

SUMMARY OF THE INVENTION

According to the invention in its broader aspects a primer composition is provided that comprises:

(a) a percussion sensitive organic primary explosive;
(b) a mechanical frictionator;
(c) a fuel; and
(d) an oxidizer selected from the group consisting of cesium nitrate, strontium sulfate, strontium oxalate, sodium oxalate, nitroguanadine, guanadine nitrate, cupric oxide, calcium oxalate, zinc formate, cobalt formate, zirconium oxide and ferric oxide wherein said composition is otherwise free of heavy metals.

The primary explosive of preference is diazodinitrophenol (DDNP), although other non-metallic percussion sensitive materials such as triazole and tetrazole compounds may be employed.

The mechanical frictionator may be drawn from glass, cupric oxide, calcium silicide, carborundum or other known similar substances.

The light metal fuel is preferably aluminum, but may also be magnesium, zirconium, titanium, cerium or magnesium. Aluminum is preferred because of its low cost.

Diazodinitrophenol (most often referred to as DDNP) is suitable as the organic primary explosive because of its insolubility in water, a pre-requisite for preparation of wet mixes. In addition, DDNP like lead styphnate, is desensitized by water which renders its processing safer.

Although most lead styphnate formulations and previous DDNP-based mixes make use of tetracene as a sensitizer for the primary explosive, it is preferable to avoid using this compound in the priming formulation because its presence can cause possible thermal stability problems.

A sensitizer being necessary, it was chosen to use a chemically inert agent, such as glass, calcium silicide, silica microspheres, or other equivalents which will be apparent to those skilled in the art. The role of the sensitizer in all cases is to mechanically activate the DDNP upon impact of the weapon firing pin against the central portion of the primer cup. The addition of a small portion of PETN (namely pentaerythritol tetranitrate) will enhance the flame temperature which helps to more easily ignite the propellant.

The selection of the oxidizer was made on the basis that the selected chemical compound would not only be free of heavy or potentially toxic metallic ions, but also would produce only non-toxic, non-corrosive by-products. In addition, it must be processable in the form of a wet mix. This latter criterion eliminates any product susceptible of a deleterious reaction upon mixture with water either by a change in its morphology or by a chemical reaction with other products within the composition.

While it was found that the above referenced group of oxidizers are all good oxidizers for a DDNP-based formulation comprising aluminum and glass, in order to avoid having a too brisant priming composition, or weak detonations, zirconium oxide was found to be the preferred oxidant.

In the prior art, it has been known to incorporate zirconium as a burning catalyst in high explosive incendiary compositions, vis U.S. Pat. Nos. 3,865,035; 3,609,155 and 3,613,597. Zirconium has also been described for use as a solid fuel, vis. U.S. Pat. No. 2,555,333. Oxides of zirconium have also been described as follows:

- U.S. Pat. No. 3,730,093-as one reactive component in an igniter;
- U.S. Pat. No. 3,986,910-to increase the critical pressure of propellants;
- U.S. Pat. No. 3,822,154-to suppress resonant burning;
- U.S. Pat. No. 3,924,405-as a component in a solid propellant;
- U.S. Pat. No. 3,905,846-as a stabilizer in CMDB propellants;
- U.S. Pat. No. 4,419,153-as part of a pyrotechnical delay charge;
- U.S. Pat. No. 4,798,636-(by reference to German patent publication 2,427,480) as a component in a propellant;
- U.S. Pat. No. 5,088,412-zirconium oxide flakes in the combustion of missile propellants; and
- U.S. Pat. No. 3,963,543-as a frictionator in ammunition priming compositions.

None of these references teach the use of zirconium oxide as the sole, principal, or effective oxidizer in a priming composition. The last reference, which does relate to priming compositions, refers to zirconium oxide as being "relatively chemically inhert" (column 2, lines 6–11). Thus the primer of this last references specifically contains 45% styphanate, 7% lead peroxide and 20–30% barium nitrate as sources of oxygen.

While zirconium oxide is preferred as the sole oxidizer, it may be present as the predominant oxidizer, providing at least 6% of the oxygen consumed in the combustion of the fuel, based on inclusion of all sources of oxygen in the priming composition.

The foregoing summarizes the principal features of the invention. The invention may be further understood by the description of the preferred embodiments, which now follow.

DESCRIPTION OF THE PREFERRED EMBODIMENTS

We have found that a priming mix can be formulated containing DDNP at between 25 to 43% by weight, aluminum between 5.3 to 22.5% by weight, glass between 5 to 20% by weight, zirconium oxide between 22 and 46% by weight and PETN between 3 to 8% by weight. However, a priming mix with substantially the following formulation by weight is preferred:

TABLE 1

| | |
|---|---|
| 32 ± 2% | DDNP, |
| 15 ± 1% | glass, |
| 6 ± 0.5% | aluminum, |
| 41 ± 2.5% | zirconium oxide, and |
| 6 ± 0.5% | PETN |

A very small amount (0.1%) of a suitable binder is also preferably present.

Using finely granulated zirconium oxide, this priming composition provides the unique feature of producing large amounts of hot particles in the form of Zr and $AL_xO_y$ which give excellent propellant igniting properties, whatever the temperature of firing. The composition is economical and requires no major modification to manufacturing methods.

Sensitivity to impact was measured following a S.A.A.M.I. (Sporting Arms and Manufacturing Institute) test method in which a 1.94 gram steel ball was dropped from measured heights varied by one inch increments to trigger primer ignition. According to this test method $\overline{H}+4$ sigma is the parameter for the all-fire height and $\overline{H}-2$ sigma is the parameter for the no-fire height where sigma is the standard deviation for the test results about the mean height, $\overline{H}$. To be acceptable, a primer must perform in the range between $(\overline{H}+4 \text{ sigma})<11$ inches $(\overline{H}-2 \text{ sigma})>1$ inch.

We have found the following typical sensitivity data for the use of the preferred composition as a small pistol primer:

TABLE 2

Impact sensitivity tests results
(based on mean values of 3 series of 50 drop tests)

| | | |
|---|---|---|
| $\overline{H}$ | = | 2.0 |
| $\overline{H}$ − 2 sigma | = | 1.95 |
| $\overline{H}$ + 4 sigma | = | 10.58 |

This same composition was subjected to a ballistics test in the format of a 9 mm pistol round. The test results were as follows:

TABLE 3

| |
|---|
| Chamber Pressure 35 000 psi |
| Muzzle velocity 1534 feet/sec |
| Action time 1.56 milliseconds |

Tests based on the use of calcium oxalate, zinc formate, cobalt formate, copper formate, nitroguanadine, ferric oxide and cupric oxide were also effected. The results are shown in Table 4.

TABLE 4

| INGREDIENTS | | | | | | | | | |
|---|---|---|---|---|---|---|---|---|---|
| DDMP | 35.0 | 40.0 | 45 | 40 | 40 | 40 | 40 | 40 | 45 |
| Calcium Oxalate | | | | | 36 | | | | |
| Zinc Formate | | | | | | 36 | | | |
| Cobalt Formate | | | | | | | 36 | | |
| Copper Formate | | | | | | | | 36 | |
| Nitroguanadine | | | | | | | | | 36 |
| $Fe_2O_3$ | 20.0 | 16.6 | 20 | | | | | | |
| CuO | | | | 36 | | | | | |
| Aluminium | 10.0 | 15.0 | 6 | 14 | 14 | 14 | 14 | 14 | 9 |
| Glass Powder | 21.0 | 19.8 | 19 | 10 | 10 | 10 | 10 | 10 | 10 |
| Binder | 0.15 | 0.15 | 0.15 | 0.15 | 0.15 | 0.15 | 0.15 | 0.15 | 0.15 |
| Sensitivity | | | | | | | | | |
| $\bar{H}$ − 2 Sigma | 2.06 | 3.04 | 2.32 | 1.02 | 1.02 | 4/30 | 16/30 | 16/30 | 28/30 |
| H + 4 Sigma | 12.86 | 11.86 | 11.14 | 14.7 | 14.7 | firing at 12 in | firing at 12 in | firing at 12 in | firing at 12 in |

(Humidity - Approx 15% by weight)

While tests were performed on the further alternate oxidizers referenced above, they all produced less satisfactory results. Nevertheless, they were able to function within a primer, albeit in many cases outside of S. A. A. M. I. standards.

In preparing the primer composition, the ingredients are wetted in the usual way with water at room temperature, taking the primer explosive first in order, to form a paste with a water content of 10–15% by weight. This paste is then spread using a flexible tool to fit precisely-sized depressions formed in a perforated plate from whence the individual, pelletized, quantities of the primer composition can be transferred to metal caps. In all respects, the method of preparing the primer may follow general well-known procedures in the field.

CONCLUSION

The foregoing has constituted a description of specific embodiments showing how the invention may be applied and put into use. These embodiments are only exemplary. The invention in its broadest, and more specific aspects, is further described and defined in the claims which now follow.

The embodiments of the invention in which an exclusive property is claimed are as follows:

1. A priming composition suitable for small arms primers which comprises:

(a) a percussion-sensitive organic primary explosive;

(b) a sensitizer for mechanically activating said explosive;

(c) a metallic fuel; and (d) an oxidizer selected from the group consisting of cesium nitrate, sodium oxalate, nitroguanadine, guanadine nitrate, penthrite, zirconium oxide, and mixtures thereof wherein said composition is otherwise substantially free of heavy metals.

2. The composition of claim 1 wherein the percussion-sensitive organic primary explosive is diazodinitrophenol.

3. The composition of claim 1 wherein the sensitizer is selected from the group consisting of glass, calcium silicide and silica microspheres and mixtures thereof.

4. The composition of claim 3 wherein the sensitizer is glass.

5. The composition of claim 1 wherein the metallic fuel is selected from the group consisting of magnesium, aluminum, zirconium, titanium, and cerium-magnesium and mixtures thereof.

6. The composition of claim 1 wherein the metallic fuel is aluminum.

7. The composition of claim 1 wherein the oxidizer is zirconium oxide.

8. The composition of claim 5 wherein the oxidizer is zirconium oxide.

9. The composition of claim i comprising the following components by weight: 25 to 43% diazodinitrophenol by weight, 0 to 10% aluminum, 5 to 20% of glass, between 22 and 46% of zirconium oxide and between 3 to 8% pentaerythritol tetranitrate, the total of all components being 100% by weight.

10. The composition of claim 9 wherein said components are present substantially in the proportions: 32% diazodinitrophenol, 15% glass, 6% aluminum, 41% zirconium oxide, and 6% pentaerythritol tetranitrate, all percentages being calculated by weight.

11. The composition of claim 2 wherein an effective amount of zirconium is provided as the sole or predominant oxidizer.

12. The composition of claim 3 wherein an effective amount of zirconium is provided as the sole or predominant oxidizer.

13. The composition of claim 1 wherein zirconium is the sole or predominant oxidizer, supplying at least 6% of the total oxygen consumed in the combustion of the primer composition.

14. The composition of claim 3 wherein zirconium is the sole or predominant oxidizer, supplying at least 6% of the total oxygen consumed in the combustion of the primer composition.

15. The use of the composition of claim 1 as a primer.

16. A cartridge having a primer as described in claim 1.

17. A method of forming a priming composition suitable for small arms primer which comprises blending a mixture of:

(a) a percussion-sensitive organic primary explosive,;

(b) a sensitizer for mechanically activating said explosive;

(c) a metallic fuel; and (d) an oxidizer selected from the group consisting of cesium nitrate, strontium sulfate, strontium oxalate, sodium oxalate, nitroguanadine, guanadine nitrate, penthrite, zirconium oxide, and mixtures thereof wherein said composition is otherwise substantially free of heavy metals.

* * * * *